United States Patent [19]

Rambousek et al.

[11] 4,030,279

[45] Mar. 30, 1977

[54] HIGH-SPEED SPINDLE HOLDER SUSPENSION FOR OPEN-END SPINNING MACHINES

[75] Inventors: Miroslav Rambousek; Ladislav Kapl; Milos Mladek, all of Usti nad Orlice, Czechoslovakia

[73] Assignee: Elitex, Zavody textilniho strojirenstvi, generalni reditalstvi, Liberec, Czechoslovakia

[22] Filed: Dec. 1, 1975

[21] Appl. No.: 636,433

[30] Foreign Application Priority Data

Nov. 29, 1974 Czechoslovakia ..... 8171/74

[52] U.S. Cl. ..... 57/58.89; 57/58.95;

[51] Int. Cl.[2] ..... D01H 1/12; D01H 7/00 D01H/13/26

[58] Field of Search ..... 57/34 R, 58.89–58.95, 57/56

[56] References Cited

UNITED STATES PATENTS

| | | | |
|---|---|---|---|
| 3,511,045 | 5/1970 | Bures et al. | 57/58.95 X |
| 3,648,450 | 3/1972 | Prochazka et al. | 57/58.89 |
| 3,918,248 | 11/1975 | Suzuki | 57/58.89 X |
| 3,927,516 | 12/1975 | Stahlecker | 57/58.89 |

*Primary Examiner*—Donald Watkins

[57] ABSTRACT

High-speed spindle holder suspension in textile machines, particularly open-end spinning machines. The suspension includes a sleeve and a pin; between the contact surfaces of the sleeve and the pin there is mounted a resilient damping element made of low density polyethylene. Preferably the low density polyethylene has a molecular weight of about 106 and a hardness of 60 to 80 on the Shore durometer scale.

5 Claims, 4 Drawing Figures

HIGH-SPEED SPINDLE HOLDER SUSPENSION FOR OPEN-END SPINNING MACHINES

,

The present invention relates to a high-speed spindle holder suspension in textile machines, particularly open-end spinning machines.

A common feature of most recent technological procedures in the textile industry is the use of continuously increasing speeds of operating elements. For example, the speed of rotation of spinning chambers in open-end spinning machines is now 30,000 – 50,000rpm; from the viewpoint of constantly rising requirements for products made on such machines, it is desirable further to increase the speed of rotation of the spinning chambers. Together with the inreasing speed of the operative elements, there arise problems connected with the high level of vibration thus created together with the corresonding attacking of elements induced by corrosion due to the necessary clearance values of said elements. This vibration corrosion may lead in a short time to the destructon of important machine assemblies asl, e.g., high-speed spindles, spinning mechanisms, etc. A further undesired phenomenon accompanying the increase of rotation is the increasing noise of the operating device which adversely affects the machine attendants. All of these factors enter into the determination of the maximum permissible speed of the apparatus.

An undesired rapid wearing of mutually contacting elements with constructional clearances is observed particularly in open-end spinning machines at speeds of spinning chambers amounting to 30,000rpm and higher when a textile material of inferior quality with a hih content impurities and admixtures, prevailingly cotton of inferior quality and imperfectly cleaned, is being treated by the apparatus. In that case, a failure in balancing of the spinning chamber is observed after a short time in connecton with the high speed of ortation of the spinning chamber (the imbalance being 5to 10times higher than the permissible imbalance limit). Even when this imbalance does not have a decisive influence on the spinning process, excessive vibration of the whole spinning unit is observed, and the noise of the device also rises due to transmission of vibrations to the macine frame. After 100to 200hours of operatin, a strong vibration corrosion may be observed, usually observed, usually on the contact surfaces of the spinning chamber holder suspension.

Because the fastening of the spinning chambers, from the viewpoint of textile technology, must provide access into the spinning chamber, and moreoer must provide for the precise positioning of the spinning chamber relative to the spinning chamber is mostly used.

The purpose of the present invention is to minimize the above-mentioned disadvantages while simultaneously providing a durable and reliable connection of the holder of the spinning chamber with the body of the combing-out device.

In accordance with the present invention, the high-speed spindle holder suspension, which includes a sleeve and a pin, has an elastic damping element of low pressure polyethylne mounted between the contact surfaces of said parts. , The holder suspenson of the high-speed spindle mounting according to the present invention is described in the following specificatin and is shown in the form of an exemplary embodiment in the accompanying drawings in which.

Figure 1:
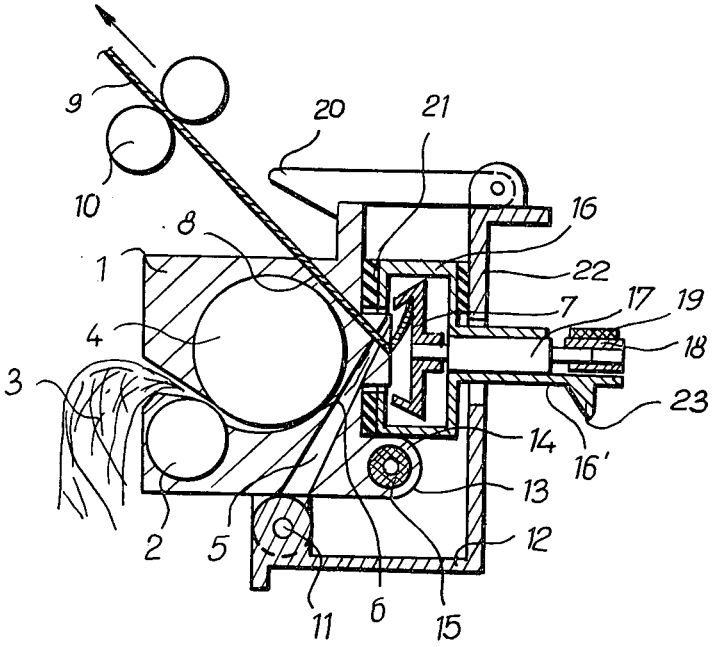
FIG. 1 is a view partially in side elevation and partially in vertical section of a spinning unit of an open-end spinning machine with the high-speed spindle in operative position.

The spinning unit of the illustrative open-end spinning machine has a body 1 of the combining-out mechanism, the main part of which is formed by a feeding roller 2 which feeds fibrous material 3 in the direction of the arrow 31 to a combing-out cylinder 4. Body 1 has a feeding channel 5 for withdrawing the combed-out fibers 6 into spinning chamber 7 and a delivering channel 8 for withdrawing the produced yarn 9 from the spinning chamber 7 between a pair of opposed withdrawing rollers 10. The body of the combing-out mechanism has a suspension 11 for its connecton to the frame 12 of the open-end spinning machine.

, To the body 1 of the combining-out mechanism there is fastened a holder 16 for the high-speed spindle by means of a suspension consiting of a sleeve 13 and a pivot pin 14 with an interpoed elastic damping elment 15 in the form of a resilient sleeve 15 (FIG. 3) having a flange 151 on one end thereof. A high-speed spindle 17, journalled in a bearing sleeve 16: is mouned on the suspension, the spindle 17 carrying a spinning chamber 7 and a pulley 18 by means of which the spindle 17 is rotated by a belt 19. The spinning unit is lockd in its operative position by means of a lock or detent 20, resilient stops 21 and 22 being provided to preventthe transmission of vibraton from the high-speed spindle 17 into the machine frame 12 and to the body of the combing-out mechanism 1. In the opened handling position (Fig. 2), the spinning unit is held, after releasing lock 20, by means of a stop dog 23 which is formed on the outer end of part 16'of the holder 16 of the high-speed spindle, dog 23 then bearing against mechine frame 12.

Figure 2:
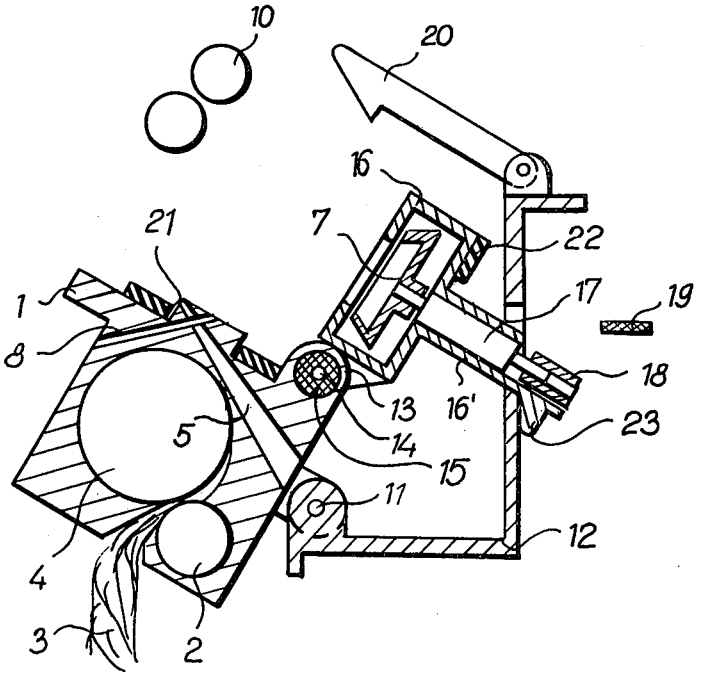
FIG. 2 is a view similar to FIG. 1 with the spinning unit in its opened, inoperative position.

When the spinning process is interrupted and with the holder in the position of FIG. 2, the feeding cylinder 2 interrupts the feeding of fibrous material by the intermediary of a clutch (not shown), and the pulley 18 of the high-speed spindle 17 is also disconnected from pulley 19. In that position, the attendant cleans cspining chamber 7 from impurities which have entered said chamber during the spinning process. The suspension of holder 16 of high-speed spindle 17 makes it possible to tilt the spinning unit into the closed position of FIG. 1, and secures thereby the precise position of spinning of slpinning chamber 7 relative to the body of the combing-out mechanism 1. The resilient damping element 15 of holder suspension 16 lprevents any transmission of vibration from the high-speed spindle 17 to the body of the combing-out mechanism 1. It isnecessary that the pin 14 be firmly fastened in holder 16 (or alternatively on the body of combing-out mechanism 1, e.g., by a set screw 24, or by being pressed on, screwed on, etc.) Thkus the occurrence of vibration corrosion is prevented, as well as ralpid wearing of the mounting connected therewith.

Figure 3:
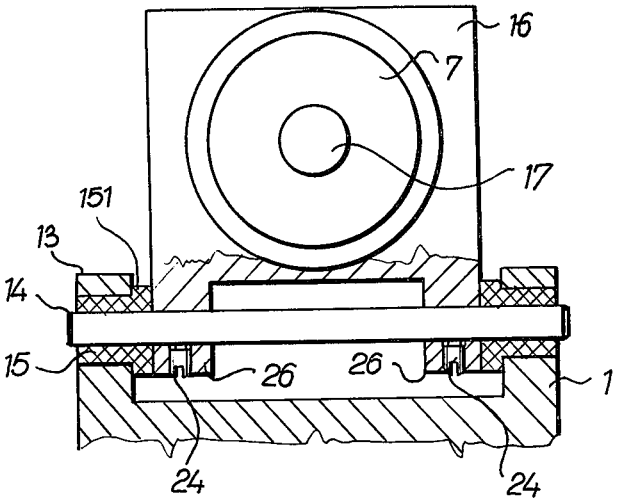
FIG. 3 is a view partially in front elevation and partially in vertical transverse section through a first embodiment of the holder suspension according to the present invention.
Figure 4:
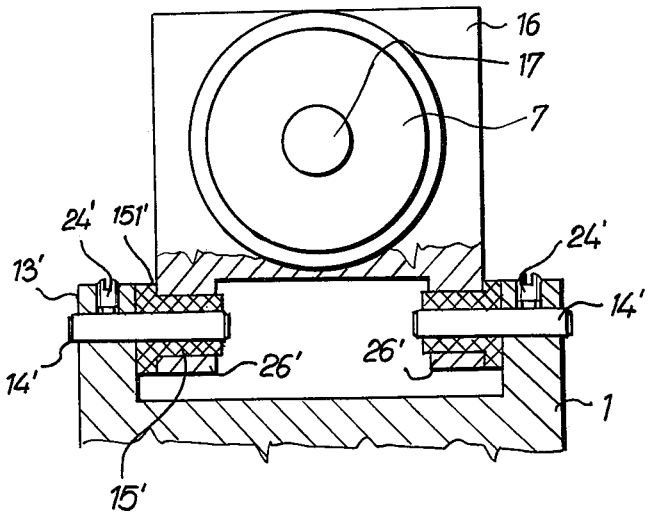
FIG. 4 is a view similar to FIG. 3 of a second embodiment of the holder suspension in accordance with the invention.

Parts in FIG. 4 which are similar to but differ from those shown in FIG. 3 are designated by the same reference characters with an added prime (').

In the embodiment of FIG. 3, there is employed a single pivot pin 14, set screws 24 being threaded into spaced ears 26 through which pin 14 extends. In the embodiment of FIG. 4, two aligned pivot pins 14'are used, set screws 24'being screwed into the upstanding spaced ears 13'on member 1, and such latter ears are disosed outside the ears 26A'on part 16. In the embodiment of FIG. 3, the flanges 151 of the resilient sleeves 15 are positioned axially inwardlyd, whereas in FIG. 4 the flanges 151 of the sleeves 15'are positioned laterally outwardly. In both embodiments the resilient damping element has flanges (151 in FIG. 3 and 151'in FIG. 4) separating the front contact surfaces of holder of the spindle and those of sleeve (13 in FIG. 1 and 13'in FIG. 4). It is advantageous to position the resilient damping elements 15 at a maximum distance from each other due to the necessity of retaining the torque of the high-speed spindles 17.

The holder suspension according to the present invention is preferably applicable in open-end spinning machines provided with spinning units mouned tiltably on the machine frameand provied with a spinning mechanism comprising high-speed spindles with a spinning chamber. From the viewpoint of manufacture, the device according to the present invention is simple and economically advantageous, increasing the lifetime of operation of decisive assemblies of open-end spinning machines for several times.

The resilient damping elements 15 and 15'are preferably made of low density polyethlene having a molecular weight of 106,a hardness of 60-80on the Shore durometer scale, and a density of 0.910 – 0.925g/cm$^3$.

Although the inventin has been illustrated and described with reference to a plurality of embodiments thereof, it is to be expressly understood that it is in no way limited by the specific disclosure of such embodiments, but is capable of numerous modificatins withing the scope of the appended claims.

What is claimed is:

1. In a high-speed open-end spinning machine having a body upon which there is pivotally mounted a holder for a high-speed spindle, the improved pivotal mounting means which comprises a sleeve and a pivot pin extending into the sleeve, the sleeve bieng connected to one of the body and the holder, and the pivot pin being conncted to the other of the body and the holder, and a resilient damping element disposed between the contact surfaces of the sleeve and pin and having a flange which separates the front contact surfaces of the sleeve and the holder.

2. A holder suspension as claimed in claim 1 wherein the resilient damping element is made of low-density polyethylene.

3. A holder suspension of high-speed spindles as claimed in claim 1, characterized in that the resilient damping element is made of low density polyethylene of a molecular weight of about 106and a hardness of 60to 80 on the Shore durometer scale.

4. Holder suspension as claimed in claim 1, wherein the pin is firmly fastened in the spindle holder and is rotatably mounted in the resilient damping element.

5. Holder suspension as claimed in claim 1, wherein the pin is firmly fastened in the sleeve and is rotatably mounted in the resilient damping element.

* * * * *